US005704559A

United States Patent [19]

Fröberg et al.

[11] Patent Number: 5,704,559

[45] Date of Patent: Jan. 6, 1998

[54] REFINING ELEMENT

[75] Inventors: Per Fröberg, Tampere; Veikko Kankaanpää, Valkeakoski; Juha Mäkivaara, Tampere, all of Finland

[73] Assignee: Sunds Defibrator Industries AB, Sweden

[21] Appl. No.: 750,639

[22] PCT Filed: Jun. 12, 1995

[86] PCT No.: PCT/SE95/00699

§ 371 Date: Dec. 12, 1996

§ 102(e) Date: Dec. 12, 1996

[87] PCT Pub. No.: WO96/00615

PCT Pub. Date: Jan. 11, 1996

[30] Foreign Application Priority Data

Jun. 29, 1994 [SE] Sweden ..... 9402282

[51] Int. Cl.[6] ..... B02C 7/12

[52] U.S. Cl. ..... 241/261.3; 241/296; 241/297

[58] Field of Search ..... 241/261.2, 261.3, 241/296, 297, 298

[56] References Cited

U.S. PATENT DOCUMENTS

| | | | |
|---|---|---|---|
| 2,654,295 | 10/1953 | Sutherland | 241/261.3 X |
| 2,968,444 | 1/1961 | Jones | 241/297 X |
| 3,149,792 | 9/1964 | Textor | 241/261.3 |
| 4,061,283 | 12/1977 | Kahmann | 241/261.3 |
| 4,166,584 | 9/1979 | Asplund | 241/261.3 |
| 4,269,362 | 5/1981 | Berggren | 241/28 |
| 4,423,845 | 1/1984 | Frazier et al. | 241/261.3 |
| 5,039,022 | 8/1991 | Nilsson | 241/261.1 |
| 5,042,726 | 8/1991 | Reinhall | 241/28 |
| 5,244,159 | 9/1993 | Newnan | 241/261.3 |

FOREIGN PATENT DOCUMENTS

| | | |
|---|---|---|
| 0 417 063 A2 | 3/1991 | European Pat. Off. . |
| 435 942 | 10/1984 | Sweden . |

*Primary Examiner*—John M. Husar

*Attorney, Agent, or Firm*—Lerner, David, Littenberg, Krumholz & Mentlik

[57] ABSTRACT

A pair of co-operating refining elements (10, 11) intended for a disc refiner with two opposed refining discs, one of which is stationary (stator) and the other one is rotary (rotor), for the working of lignocellulosic fiber material in a refining gap (12) between the co-operating refining elements (10, 11). The refining elements are provided with a pattern of bars (13–16) and intermediate grooves. Each bar is formed with a plurality of high bar portions (13, 15) and intermediate low bar portions (14, 16), counted in radial direction. High bar portions (13, 15) are located directly in front of low bar portions (14, 16) on opposed co-operating refining elements (10, 11). The length of the high bar portions (15) on refining elements (11) of the rotor exceeds the length of the high bar portions (13) on refining elements (10) of the stator.

4 Claims, 2 Drawing Sheets

REFINING ELEMENT

FIELD OF THE INVENTION

The present invention relates to working and dispersing lignocellulosic fiber material, preferably wood pulp containing recycled fiber, during the refining thereof. More particularly, the present invention relates to refining elements for use in disk refiners, intended for said refining.

BACKGROUND OF THE INVENTION

Known disk refiners generally comprise two opposed refining disks, which are rotary relative to each other and on at least one of which a plurality of refining elements are arranged. These refining elements are formed with a pattern of bars and intermediate grooves. The refining disks are arranged so that a refining gap is formed between the refining elements, through which the fiber material is intended to pass in an outward direction therebetween. In this manner, the dispersing and refining functions are carried out by the bars of the refining elements.

In the inner portion of the refining gap the refining elements are generally formed with coarse bars to initiate the disintegration of the fibrous material and to feed it outwardly to the outer portion of the refining gap, where working of the fibrous material takes place.

For the dispersing type of refining, the type of refiner is normally used which comprises one stationary refining disk and one opposed rotary refining disk. This type of treatment, which is carried out on preheated fiber material, which is generally present in high concentrations, has the object of utilizing lenient working to provide a pulp of improved quality. The purpose of dispersing normally is to utilize mechanical treatment to unbind from the fibers in the pulp impurities, generally in the form of printing ink and so-called hot-melts (plastic and glue particles), and to disintegrate these impurities to a sub-visible size without negatively affecting the fibers. The freeness (CSF) of the pulp therefore must not be appreciably reduced.

With conventional refining elements, which employ substantially radial bars in the refiner, capacity problems can arise when an effective working of the fiber material is to be obtained. On the other hand, quality problems can arise when the capacity is increased. Furthermore, the freeness of the pulp is reduced. Also, while the tensile strength can certainly be improved thereby, the disintegration of impurities, or the so-called speck reduction, will then be relatively poor.

By designing the refining elements with toothed working surfaces instead of radial bars, a lenient working with good speck reduction is obtained. The freeness of the pulp is not reduced appreciably, and the strength properties of the pulp are affected only insignificantly.

SUMMARY OF THE INVENTION

In accordance with the present invention, these and other objects have now been realized by the invention of apparatus for refining lignocellulose-containing material which comprises a first stationary refining disk having a first refining surface and a second rotatable refining disk having a second refining surface, the first and second refining disks being mounted with the first and second refining surfaces facing each other in opposed relationship thereby defining a refining gap therebetween, the first refining surface including a plurality of radially extending first bars separated by a plurality of grooves and the second refining surface including a plurality of radially extending second bars separated by a plurality of grooves, the plurality of radially extending first bars including a plurality of first raised portions alternating radially with a plurality of first depressed portions, the plurality of radially extending second bars including a plurality of second raised portions alternating radially with a plurality of second depressed portions, the plurality of first raised portions being located opposite the plurality of second depressed portions, and the plurality of second raised portions being located opposite the plurality of first depressed portions, the plurality of first raised portions having a first predetermined length and the plurality of second raised portions having a second predetermined length, the first predetermined length being less than the second predetermined length.

In accordance with one embodiment of the apparatus of the present invention, the plurality of second raised portions includes an upper surface forming an angle with respect to a plane parallel to the second refining surface such that the height of the plurality of second raised portions increases in a direction radially outwardly within the refining gap.

In accordance with another embodiment of the apparatus of the present invention, the plurality of radially extending first bars includes a plurality of first wall portions separating the plurality of first raised portions from the plurality of first depressed portions, the plurality of first wall portions being inclined with respect to a direction perpendicular to the first refining surface. In a preferred embodiment, the plurality of radially extending second bars includes a plurality of second wall portions separating the plurality of second raised portions from the plurality of second depressed portions, the plurality of second wall portions being inclined with respect to a direction perpendicular to the second refining surface.

In accordance with the present invention, the cooperating refining elements are designed in a manner which provides them with alternatingly high and low bar portions resulting in effective speck reduction without appreciably reducing the freeness of the pulp while at the same time improving the strength properties of the pulp. In addition, a high capacity can be maintained therewith.

BRIEF DESCRIPTION OF THE DRAWINGS

The present invention may be more fully appreciated with reference to the following detailed description, which, in turn, refers to the drawings in which.

DETAILED DESCRIPTION

Figure 1:
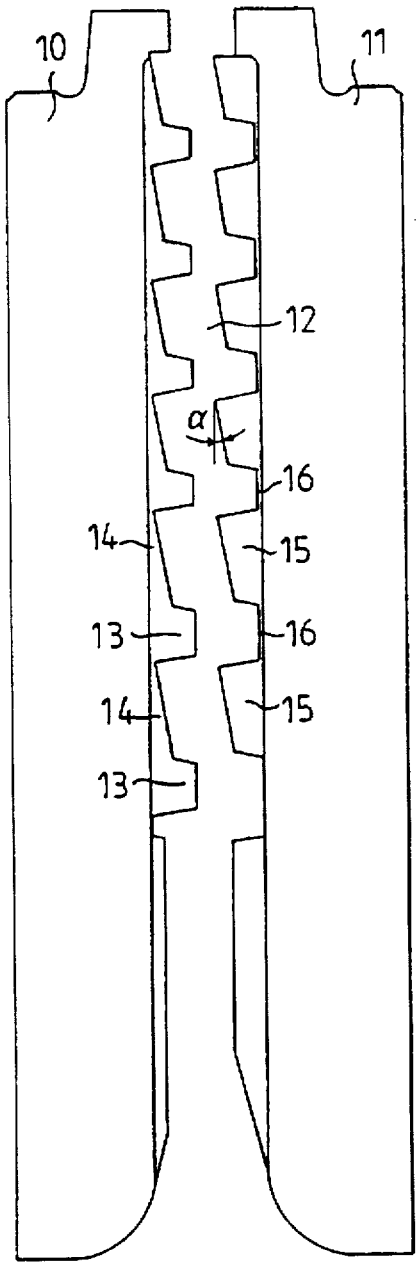
FIG. 1 is a side, cross-sectional view of a pair of cooperating refining elements in accordance with the present invention.
Figure 2:
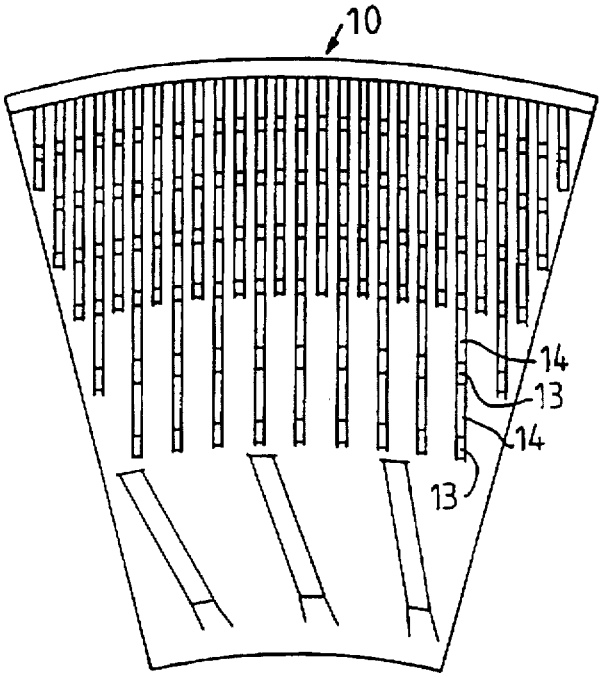
FIG. 2 is a front, elevational view of a stationary refining element in accordance with the present invention.
Figure 3:
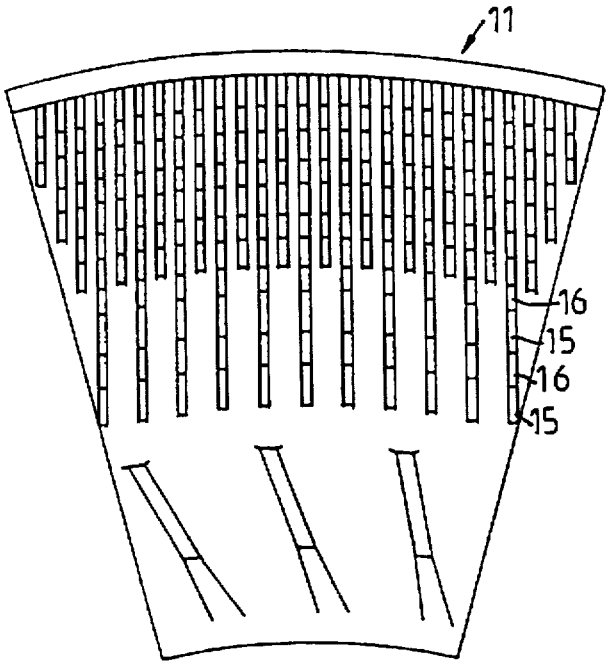
FIG. 3 is a front, elevational view of a rotary refining element in accordance with the present invention.

Referring to the drawings, in which like reference numerals refer to like elements thereof, FIG. 1 shows cooperating refining elements 10 and 11, which are intended to be positioned on each of two opposed refining disks in a refiner where one of the refining disks is stationary and the other refining disk is rotary. One type of refining element 10 is intended for use in the stationary refining disk (stator), and the other type of refining element is intended for use on the rotary refining disk. These cooperating opposed refining elements 10 and 11 define between them a refining gap 12, through which the fiber material is to be passed outwardly from within, i.e. upwards in FIG. 1.

Each refining element 10 and 11 is provided with bars 13 and 14 and 15 and 16, respectively, which extend substantially radially across the surface of the refining elements. Alternatively, the bars can be angled in relation to the radius of the refining elements. Each bar is formed with several high or elevated bar portions 13 and 15, respectively, and intermediate low or depressed bar portions 14 and 16, respectively, proceeding in the radial direction. The bars have a configuration such that high bar portions 13 and 15 are located directly in front of low bar portions 14 and 16 on opposed refining elements. The high bar portions 15 on the refining element 11 of the rotor have a length which exceeds that of the high bar portions 13 on the refining element 10 of the stator, preferably by about 1.5 to 5 times, more preferably by about 2 to 4 times. The transition between high and low bar portions preferably consists of inclined surfaces. The height of the low bar portions 14 and 16 can be in the range of a few millimeters, preferably from about 0.5 to 2 mm.

In accordance with the embodiment shown in the drawings, the upper surface on the high bar portions 15 on the refining element 11 of the rotor forms an angle $\alpha$ with the direction of refining gap 12, i.e. with the axial plane. This angle shall be such that the height of the bar portions 15 increases as one moves radially outward. This angle $\alpha$ can vary, but preferably lies in the interval of from about 0° to 10°. Greater angles, however, can be used. The upper surface on the low bar portions 14 of the stator can have a corresponding angle, in a manner such that the height of the bar portions 14 decreases as one moves outwardly. The upper surface of the high bar portions 13 of the stator and the low bar portions 16 of the rotor, respectively, can also form an angle with the direction of the refining gap 12 in a similar way.

Due to the fact that the cooperating refining elements 10 and 11 are formed with alternatingly high and low bar portions 13 through 16, the fiber material is worked very effectively during its passage through the refining gap 12. By adjusting the refining gap, the axial distance between the bars can be changed, and at the same time the distance between opposed inclined transition surfaces between high and low bar portions is changed. Cooperating refining elements can thereby be set so that the tops of the bar portions work the fibers effectively and thereby improve the strength properties of the pulp, and at the same time the inclined transition surfaces of the bar portions knead the pulp softly and force the pulp to move between the rotor and stator. The working of the pulp is rendered still more effective due to the angled upper surfaces of the bar portions.

At the same time that this highly effective working is achieved, a high capacity is also maintained because the high bar portions 15 on the rotor have a greater length than the high bar portions 13 on the stator. This configuration yields a high pump effect, and thus a high capacity. This also applies when the refining elements have a fine pattern, i.e. when the bars and grooves are narrow.

The present invention therefore clearly creates the possibility of effectively dispersing impurities without appreciably reducing the freeness of the pulp, while at the same time the strength properties of the pulp can be improved and a high capacity could be maintained.

EXAMPLE

Refining elements according to the embodiment of the present invention shown in the drawings were test run and compared to refining elements with a conventional tooth-patterned working surface. The results obtained proved that refining elements according to the present invention yield a high speck reduction for a specified energy consumption, and a specified reduction in the pulp freeness. A clear improvement of the tensile strength of the pulp was also observed. Moreover, with refining elements according to the present invention, a higher rate of production could be maintained.

Figure 4:
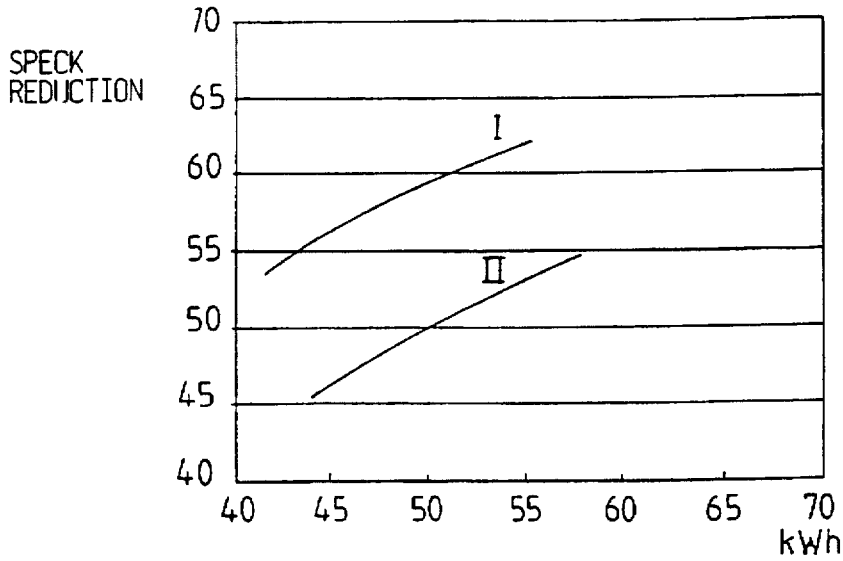
FIG. 4 is a graphical representation comparing the speck reduction as a function of energy consumption for refining elements in accordance with the present invention.
Figure 5:
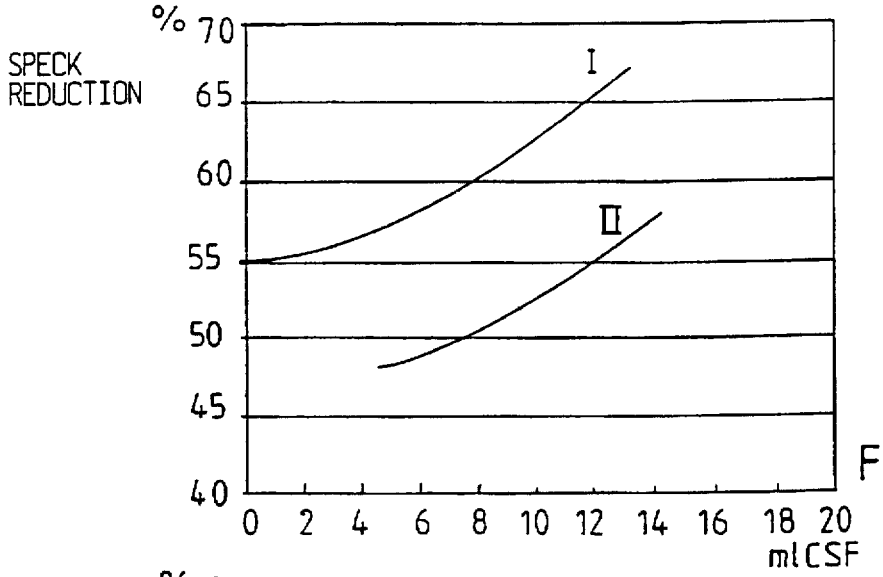
FIG. 5 is a graphical representation comparing the speck reduction as a function of freeness for refining disks in accordance with the present invention.
Figure 6:
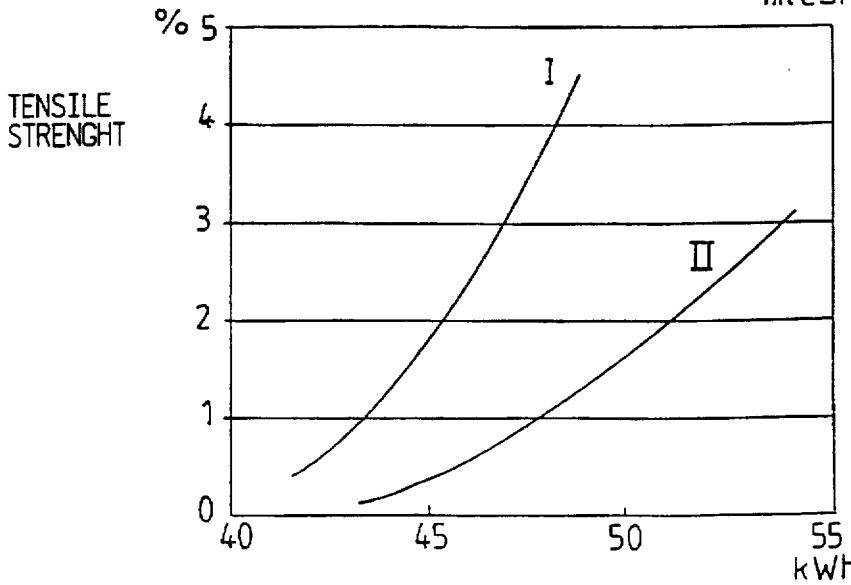
FIG. 6 is a graphical representation comparing tensile strength as a function of energy consumption for refining elements in accordance with the present invention.

The results appear from FIGS. 4–6, in which curve I refers to refining elements of the present invention, and curve II refers to the conventional refining elements.

FIG. 4 shows the speck reduction in % for particles >50 μm as a function of the specific energy consumption in kWh per ton bone dry pulp (kWh/BDT). FIG. 5 shows the speck reduction as a function of the freeness decrease in ml CSF. FIG. 6 shows the increase in tensile strength in % as a function of the energy consumption.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

We claim:

1. Apparatus for refining lignocellulose-containing material comprising a first stationary refining disk having a first refining surface and a second rotatable refining disk having a second refining surface, said first and second refining disks being mounted with said first and second refining surfaces facing each other in opposed relationship thereby defining a refining gap therebetween, said first refining surface including a plurality of radially extending first bars separated by a plurality of grooves and said second refining surface including a plurality of radially extending second bars separated by a plurality of grooves, said plurality of radially extending first bars including a plurality of first raised portions alternating radially with a plurality of first depressed portions, said plurality of radially extending second bars including a plurality of second raised portions alternating radially with a plurality of second depressed portions, said plurality of first raised portions being located opposite said plurality of second depressed portions and said plurality of second raised portions being located opposite said plurality of first depressed portions, said plurality of first raised portions having a first predetermined length and said plurality of second raised portions having a second predetermined length, said first predetermined length being less than said second predetermined length.

2. The apparatus of claim 1 wherein said plurality of second raised portions includes an upper surface forming an angle with respect to a plane parallel to said second refining surface such that the height of said plurality of second raised portions increases in a direction radially outwardly within said refining gap.

3. The apparatus of claim 1 wherein said plurality of radially extending first bars includes a plurality of first wall portions separating said plurality of first raised portions from said plurality of first depressed portions, said plurality of first wall portions being inclined with respect to a direction perpendicular to said first refining surface.

4. The apparatus of claim 3 wherein said plurality of radially extending second bars includes a plurality of second wall portions separating said plurality of second raised portions from said plurality of second depressed portions, said plurality of second wall portions being inclined with respect to a direction perpendicular to said second refining surface.

* * * * *